United States Patent [19]

Moffitt

[11] 4,307,538

[45] Dec. 29, 1981

[54] LIGHTING SYSTEM FOR DISC TOYS

[76] Inventor: Keith S. Moffitt, 2015 Anaheim St., Costa Mesa, Calif. 92627

[21] Appl. No.: 90,267

[22] Filed: Nov. 1, 1979

[51] Int. Cl.[3] ..... A63H 33/26

[52] U.S. Cl. ..... 46/228; 46/74 D

[58] Field of Search ..... 46/228, 229, 236, 226, 46/227, 74 D; 362/800; 200/DIG. 2

[56] References Cited

U.S. PATENT DOCUMENTS

| | | | |
|---|---|---|---|
| 3,812,614 | 5/1974 | Harrington | 46/74 D X |
| 3,944,843 | 3/1976 | Vaz Martins | 200/DIG. 2 X |
| 4,091,610 | 5/1978 | Sasaki et al. | 200/DIG. 2 X |
| 4,132,031 | 1/1979 | Psyras | 46/228 |
| 4,170,036 | 10/1979 | Sussel | 362/806 X |

FOREIGN PATENT DOCUMENTS

| | | | |
|---|---|---|---|
| 2734591 | 8/1978 | Fed. Rep. of Germany | 46/230 |

*Primary Examiner*—Gene Mancene
*Assistant Examiner*—Mickey Yu
*Attorney, Agent, or Firm*—Grover A. Frater

[57] ABSTRACT

A lighting system for toys such as floating disc toys wherein a plurality of point light sources are spaced apart in the plane of movement and are energized intermittently by a battery through a circuit which utilizes a single multi-NAND gate chip and finger resistance for switching.

1 Claim, 6 Drawing Figures

LIGHTING SYSTEM FOR DISC TOYS

This invention relates to improved lamp illumination systems and to toys which incorporate such systems.

BACKGROUND OF THE INVENTION

There are a number of applications for dimly lit lamps and small but identifiable lights in which power drain must be very small. The floating disc toy, sometimes called a "sport disc," is one example. Shaped like an inverted shallow bowl, the floating disc is held at one edge, open side down, and is thrown or "sailed" with a side arm motion. It spins as it moves, and it quickly slows in its movement away from the thrower to a near standstill. Near the end of its travel it seems to float or hover and is readily caught by a second player.

The floating disc is inexpensive, permits play with two players, or any number more than two players. It is easily carried, can be played with in any reasonably open space, and disparity of age of players is not a limiting factor in play. For these reasons, and others, play with floating discs is popular at picnics and other outings, and is popular for street play. However, as with many games, play must end if the disc cannot be seen or its position identified.

Fortunately, the floating disc moves slowly toward the end of its travel, and its orientation (open side down) remains nearly the same. It can be readily seen, and play can continue after dark if the disc carries lights. The lights need not be so bright as to furnish illumination beyond the disc. It is enough if the lights glow only brightly enough to be seen at a distance of fifty to one hundred feet. However, effective play is possible only if the catcher can "see" the rim of the disc.

Persistence in the catcher's optical system helps greatly. Since the disc is spinning, lighting a lamp at its edge will create the illusion of a circle of light. However, a lamp placed so that it is visible through a complete or nearly complete turn of the disc would necessarily protrude or project from the disc and be subject to damage when the disc was not caught. Even worse, it might injure the catcher if caught.

Such considerations in the case of floating discs and other practical problems in the case of other applications, particularly in toys, often lead to a requirement for greater amounts of energy. When energy is to be supplied by an electrical battery, the requirement for more energy translates into increased cost and increased size and weight. Increases in those elements of a design usually can have a profound effect on the toy or other apparatus for which lights are but an accessory. In the case of the floating or sport disc, the problem has been to find a lighting system which will provide enough light for nighttime play which will provide an acceptable compromise between battery weight and "floating" characteristics of the floating disc, and which can be provided at a price that users can be expected to be willing to pay. That problem has gone unsolved until the making of this invention.

SUMMARY OF THE INVENTION

It is an object of the invention to provide an improved lighting system generally, and particularly for toys.

Another object is to provide an improved system for providing identification and decorative lighting for toys.

A further object is to provide an identification lighting system for floating disc toys.

In the matter of floating disc toys, the invention provides a system in which several light emitting diodes are mounted on the perimeter of the disc and are driven to radiate a small quantity of light sufficient in view of persistence of the eye to define the position of the disc in darkness. The diodes are driven by a relatively high voltage, low current supply system, and they are driven only intermittently to minimize supply battery weight. The use of control circuitry to turn the diodes off periodically represents a compromise between battery weight on one hand and cost and control system weight on the other. That tradeoff is made favorable by the use of special circuitry, including switching, by making use of the user's hand as a switching current flow path. To provide such switching, such special circuitry, such a power supply, such intermittent switching, and such a lighting arrangement, and to provide combinations of those features are all objects of the invention.

These and other objects and advantages of the invention which will appear in a reading of the description that follows are realized, in part, by the combination of lamps, an electrical power source, and a control means for causing illumination of the lamps intermittently. In the floating disc it is preferred, and a feature, to use light emitting diodes as lamps, and to mount them spaced around the outer periphery of the disc, and to turn them on and off in unison thus to take twofold advantage of persistence in the human eye.

THE DRAWINGS

DESCRIPTION OF THE PREFERRED EMBODIMENT

Figure 1:
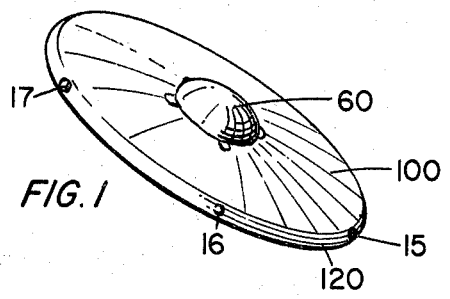
FIG. 1 is a perspective view of a floating disc in which the invention is embodied.
Figure 6:
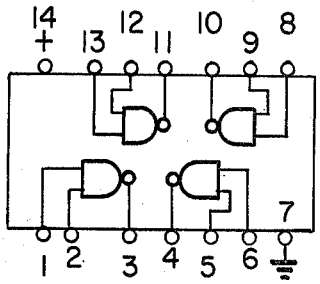
FIG. 6 is a diagram of a preferred electronic component for the excitation control unit.
Figure 3:
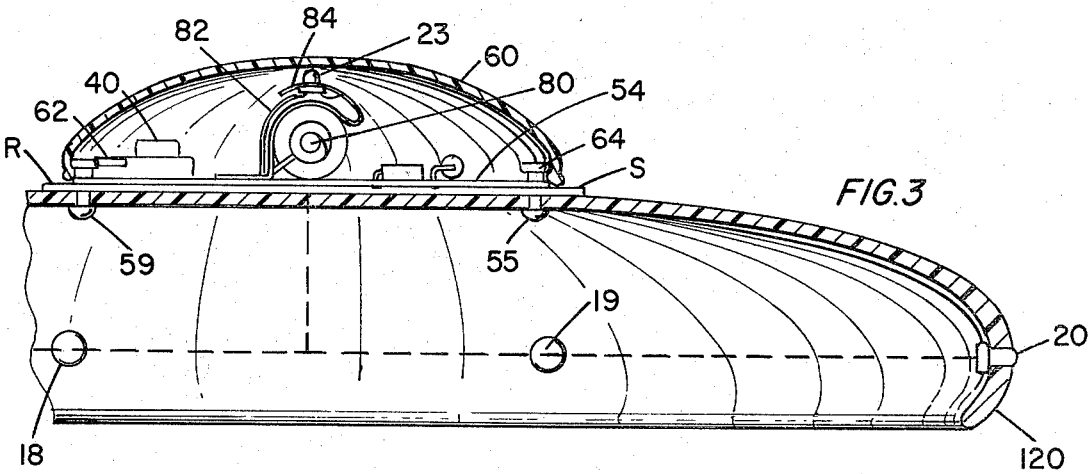
FIG. 3 is a cross-sectional view taken on line 3—3 of FIG. 2.

The preferred form of the invention is shown in the drawing. It is shown in FIG. 1 to comprise a floating disc toy the body 100 which has conventional shape. Except that it is inverted in use, it is shaped much like a shallow bowl whose rim 120 is turned inwardly. The inward turning is best seen in FIG. 3 which also shows that wall thickness is increased at the outer margins of the body from what it is in the central region of the body.

This preferred embodiment includes eight lamps, one at the upper side and the other seven which are carried at spaced points on the outer circumference of the disc. Three of those lamps, 15, 16 and 17, are visible in FIG. 1. There are five more, 18, 19, 20, 21 and 23, and they are visible in the other figures.

These several lamps are light emitting diodes encased in a transparent plastic housing shaped to serve as lenses to direct light outwardly away from the base. The housings are small and strong and the liklihood of breakage is very small indeed. The ends of the lamps protrude slightly from the disc body but only in small degree. The lamp housing has an enlarged skirt at its base end which serves as a stop. The lamp is pressed into an opening in the wall of the disc until the base of the lamp abuts the inner wall of the disc.

When in play, the disc spins about its central axis and the plane of rotation, which contains the major circumference of the disc, remains nearly horizontal. The player who is to catch it sees it primarily edge on so the lights must be visible from the edge. If the catcher fails to catch the disc it will fall and, in most cases, come to rest bottom side down. To facilitate its being found, the lights are best located at the top and primarily at the edge. Thus it is that the preferred position for the lights is the major circumference at the edge of the disc, as shown. However, since the disc spins and is seen edge on, the lamp is visible to the catcher during only part of each revolution. That problem is overcome by the use of several lamps spaced around the periphery of the disc. In this embodiment, there are seven lamps equally spaced about the edge. Their housings are arranged as lenses to concentrate light output in a cone which makes an angle between forty-five and sixty degrees to the lamp axis. These lights, combined with persistence of the eye, give the appearance of a streak of light in the dark. That streak extends over about one-third of the circumference of the disk for an edge-on observer.

The spin rate varies greatly from player to player and from time to time. To ensure that a continuous light streak is visible, one can employ as few as four lights (seven lights is preferable) around the periphery of the disc as in this embodiment. The intensity of the lights will vary from the viewer's standpoint because of the effect of the lamp lenses. That will be overcome in part by persistence. Moreover, it is not necessary that the lights remain illuminated continuously. If they are turned on and off at a frequency that is at least several times higher than the spin frequency, and if all the lights are turned on and off simultaneously, the eye will see the light streak. The upper lamp, lamp 23 in this embodiment, is included both as a decoration and as an aid to location in darkness.

Unlike an incandescent lamp, the light emitting diode does not experience a larger inrush current at low frequency turn-on, so current drain at turn-on need not be considered in selecting a frequency for intermittent operation except as it might effect the amount of energy required to control turn-on and turn-off operation. The lamp energization control circuit of the invention uses so little energy that physical size and weight of components can be made the controlling factor in frequency selection, rather than control current drain. Frequency is controlled with a capacitor and two resistors. They control frequency and relative on and off time in each cycle.

Figure 5:
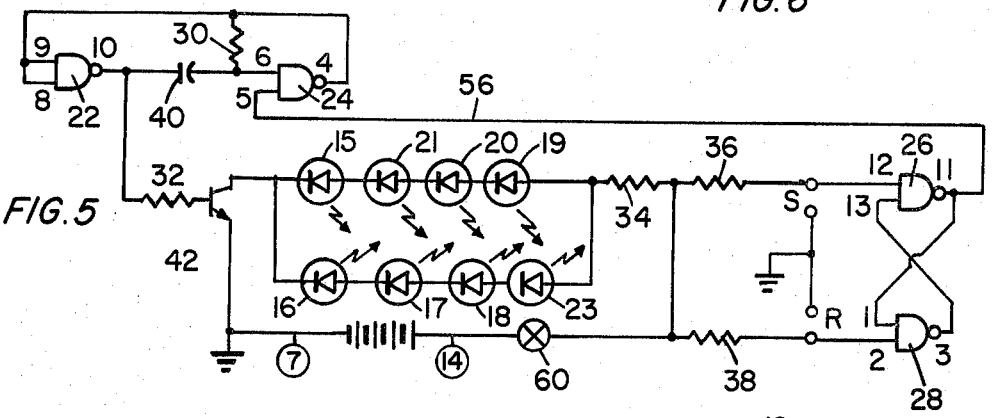
FIG. 5 is a circuit diagram describing the battery and excitation control unit of the device.
Figure 2:
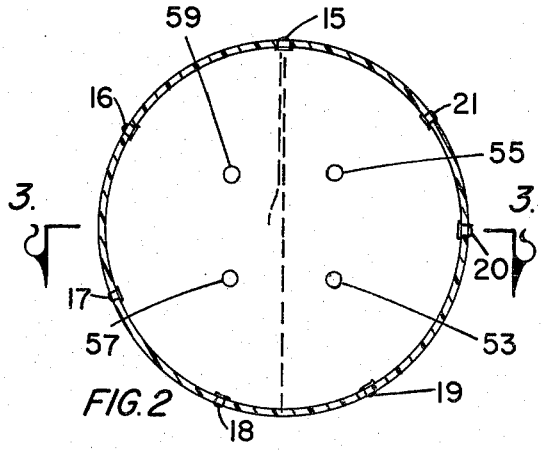
FIG. 2 is a cross-sectional view taken on the major circumference of the disc of FIG. 1 showing the underside of its upper portion.
Figure 4:
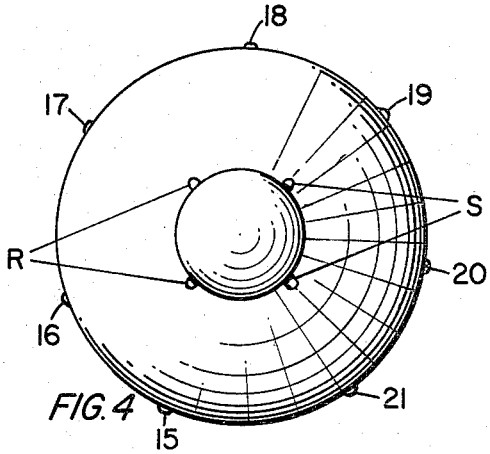
FIG. 4 is a top plan view of the disc of FIG. 1.

The circuit is shown in FIG. 5 to include four NAND gates, 22, 24, 26 and 28, and five resistors, 30, 32, 34, 36 and 38. In addition, the circuit includes a capacitor 40, a transistor 42, a battery 44, and eight light emitting diodes, 15, 16, 17, 18, 19, 20, 21 and 23. Gates 22 and 24 are connected with capacitor 40, resistors 30 and 32, and the base emitter circuit to transistor 42 to form an "oscillator" or multivibrator whose output is the energy that flows into the base of transistor 42.

Resistors 36 and 38, NAND gates 26 and 28, and the two sets of contacts S and R form a flip-flop circuit by which the user turns the multivibrator on and off.

The lamp circuit includes the collector-emitter diodes connected in two parallel sets of four in series and current limiting resistor 34. These elements are connected in a series circuit that extends from ground at the negative terminal of battery 44 to the emitter of transistor 42. From the collector of the transistor it extends through light emitting diodes 15, 21, 20 and 19, in parallel, with diodes 16, 17, 18 and 23, and then through current limiter resistor 34 to the positive terminal of battery 44. Sufficient current flows in that circuit to turn on the light emitting diodes only when transistor 42 is turned on by the application of a positive potential to the transistors' base.

The four NAND gates are packaged together in an integrated circuit "dip" package to minimize weight and size and to permit inclusion of common supply power leads. The preferred four-gate device is type 4011A, a CMOS unit. Its pin 7 connects to the negative side of the battery and to ground. Pin 14 connects to the positive side of the battery 42. The other pin connections are identified in FIG. 5 only because the circuit arrangement shown can be printed on only one side of the circuit board 54.

The output pin 11 of gate 26 is connected to input pin 1 of gate 28 whose output at pine 3 is connected to input pin 13 of gate 26. Input pins 2 and 12 of gates 28 and 26, respectively, are connected through respectively associated resistors 38 and 36 to the positive terminal of the battery 44. Two pairs of terminal points are associated with this flip-flop circuit. One pair is labelled S for "set". One terminal point connects to the junction of resistor 36 and gate pin 12. The other terminal of pair S is connected to ground. The other pair of terminals is labelled R for "reset". One of the pair is connected to circuit ground and the other is connected to the junction of resistor 38 and gate terminal 2. The output signal of this flip-flop circuit is a high or low on line 56 which is connected to gate pin 11 at its input end and to gate pin 5 of gate 24 at its other end.

It will be understood that other circuit arrangements are possible within the invention, and that the components of this circuit may have other values. However, in this preferred circuit, the components have the following values:

Resistors 30, 36, 38—10 Megohms
Resistor 32—1000 Ohms
Resistor 34—10 Ohms
Transistor 42—Type 2N2222
Capacitor 40—0.01 mfd
Gate 1C—Type 4011A
L.E.D. 15-21,23—Type FLV 315, MV 5752.

Resistors 36 and 38 maintain a high signal at inputs 12 and 2 of gates 26 and 28. If at a given time the output 11 of gate 26 is high, the input at pin 13 of that gate is necessarily low for the output can be high only if at least one input is low. Since input 13 is connected to output 3 of gate 28, a low at input 13 means that output 3 is low. Output 3 can be low only if both of inputs 1 and 2 are high. That is true, of course, because input 2 is connected to supply positive through resistor 38 and input 2 is connected to output 11 which was assumed to be high.

Returning to FIG. 1, the terminal pairs are exposed at the upper surface of the floating disc where they are spaced apart about five centimeters and are easily bridged by the fingers of a user's hand. The internal resistance of humans to current flow is quite low whereby the resistance measured between two terminals that are touched by a user's skin is essentially twice his skin resistance whether the terminals are touched by adjacent fingers of one hand or by fingers of different hands. Skin resistance is generally about 15000 ohms or less so that touching the two S terminals or the two R terminals is equivalent to placing a resistance of 30K ohms or less across them.

If the flip-flop circuit has the condition described above, bridging the R terminals with a 30K ohm resistor or with one's fingers would have no effect at output terminal 11 and output line 56. The addition of that resistor would create a voltage divider across the supply battery 44 through the 10 Megohm resistor 38 and the added 30K ohm resistance. The input impedance of the gates is high, so immediately upon completion of the voltage divider, the input terminal 2 would be pulled low. But the output 3 will change state and go high if either of its inputs goes low. Since output 3 is connected to input 13 of gate 26, input 13 goes high. In that circumstance, both input 13 and 12 of gate 26 are high and its output at pin 11 and line 56 change state and go low. Thus, the signal on line 56 will go from high to low if the R terminals are touched.

If the S terminals had been touched when the output on line 56 was high, there would have been no change. Touching the S terminals places a 30K ohm or less resistance in series with 10 Megohm resistor 36 across the battery. The junction between the resistors and input terminal 12 of gate 26 are pulled low. However, gate 26 has a high output whether only one or both of its inputs are low. No change of state occurs. However, after the flip-flop is reset by bridging the R terminals, output 11 and line 56 are low, and input 13 is high. In that condition, bridging the set terminals S will make the input terminal 12 go low and the gates will again change state.

Summarizing, when line 56 is high bridging S terminals has no effect. Bridging R terminals brings line 56 low. When line 56 is low bridging the R terminals has no effect but bridging the S terminals will bring line 56 high.

In the multivibrator output terminal 10 of gate 22 is connected to the positive side of the capacitor 40 whose negative side is connected to input terminal 6 of gate 24. The output terminal 4 of the gate is connected to the negative side of capacitor 40 through 10 Megohm resistor 30 and to input terminals 8 and 9 of gate 22. The output terminal 10 of gate 22 is also connected to the base of transistor 42 through the 1000 ohm resistor 32.

Let it be assumed that the signal on line 56 and at input 5 of gate 24 of the multivibrator are high. If there is a low at input 6 of the gate, gate output at terminal 4 is high. The gate is made so that its output serves as a positive potential and current source in its high state and as a near short circuit which can sink current to ground in its low state. Since output terminal 4 is high, the input terminals 8 and 9 of gate 22 are high and output terminal 10 of gate 22 is low. The positive side of capacitor 40 is near ground potential, and very little current flows across the emitter to base junction of transistor 42. The transistor and the light emitting diodes are turned off.

Current flows in this period through the ten Megohm resistor 30 to charge capacitor 40 negative side positive. Eventually, the potential at input 6 becomes high. Since both input 5 and 6 are high, output 4 of gate 4 must go low. If either or both of inputs 8 and 9 go low, as they must if output 4 is low, the output 10 of gate 22 goes high. Flow at capacitor 40 is reversed. Current flows out of the negative side of the capacitor through resistor 30 to ground through output terminal 4 of gate 24, but that flow is slow because of the high value of resistor 30 and capacitor 40 charges relatively slowly. Eventually the capacitor is charged sufficiently so that its side toward input 6 of gate 24 is reduced to a low potential. At that point, gate 24 changes state and gate 22 is forced to change state back to low output condition. Thus does the multivibrator process proceed while terminal 5 of gate 24 is held high by line 56. During intervals when the output terminal 10 of gate 22 is high, a positive potential is applied to the base of transistor 42 to turn it on and permit energizing current to flow through the light emitting diodes.

If the reset terminals are bridged, line 56 and terminal 5 of gate 24 will go low. In that circumstance the output of gate 24 and the input of gate 22 must go high and output 10 must go low. That action turns off transistor 42 and the light emitting diodes are not illuminated again until the set terminals are bridged.

Thus far described the circuit includes no means for turning off all power to the gates. The current drain in these CMOS devices is such that there is no need to open the power circuit. The batteries are not installed until the disc is to be used by the ultimate purchaser. If it is desired to prolong battery life by what little can be gained in opening the battery circuit, a switch 60 would be included as shown in FIG. 5.

Returning to FIGS. 1, 2, 3 and 4, the lamp excitation control unit is mounted on the spin axis of the disc at its upper side. The components of FIG. 5 are mounted on a printed circuit board 54. The board is held in place with four fasteners 53, 55, 57 and 59. Each includes a rivit of non-conductive plastic material, a flanged metal sleeve which makes contact with an appropriate circuit run of the circuit board, and a metal washer which contacts the metal sleeve. The four flanged sleeves, one in each of the four corners of the circuit board, serve as holders for a non-conductive protective plastic cover 60. The cover is circular in top plan view and a half elipse in vertical cross-section, as best shown in FIG. 3.

The cover is formed with an inwardly extending flange on its inner surface near its rim. In assembled condition, that flange is disposed under the flanges of the four flanged sleeves. The cover is made of a somewhat resilient material which deforms sufficiently to permit the cover 60 to be "snapped" on and off the four flanged sleeves of the fasteners. For identification, the two flanged sleeves that are visible in FIG. 3 are numbered 62 and 64. The washer associated with each fastener is elongated at one side and is oriented so that it extends outside of the cover 60 when assembled on the fastener. The four washers are really terminals. Two of them are marked S. They are the set terminals S of FIG. 5. The other two are marked R. They are the reset terminals of FIG. 5. One of each set is visible in FIG. 3 where they are marked R and S, respectively.

The battery 80 is a size A drycell of the kind that has a snap on terminal at each end. It is held in place by a spring clip 82 which is rivited to the circuit board 54. The end of the clip is bent back upon itself at 84. That end portion is spaced from the clip body, and it is made to retain one of the light emitting diodes, specifically diode 23. In preferred form, the cover or dome 60 is made of translucent, lightweight plastic material whereby the lamp 23 will appear to illuminate the whole of the dome or cover 60.

In this preferred form, the conductors by which the lamps are energized are imbedded in the body of the disc. Those that extend from the region of the excitation controller to the circumference of the disc are shown in dotted lines. The lamps are connected by other lines which extend along the inner circumference are too small to be seen in FIG. 2, but they are shown in dotted lines in FIG. 3.

While I have shown only one embodiment of my invention, I am aware that other embodiments are possible. Accordingly, the invention is to be measured not by the details of this embodiment but by the scope of the appended claims.

I claim:

1. A lighted floating disc toy comprising:

a floating disc body;

a plurality of lamps mounted at spaced points on said body;

a source of electrical energy;

energizing means for energizing said lamps from said source intermittently;

said energizing means comprising a multi-vibrator connected between said source and said lamps;

said multivibrator comprising a capacitor and a resistor and first and second NAND gates, each having at least two inputs, the output of the first gate being connected to a first input of the second gate through said capacitor, and a second input of the second gate being connected through said resistor to the output of said second gate and the inputs of the first gate;

said multivibrator further comprising a path through a resistor for discharging said capacitor; and means in the form of at least first, second and third separate exposed terminals, and a flip-flop, for rendering said energizing means effective and ineffective, selectively, in response to simultaneous touching of said first terminal and one of said second and third terminals, respectively.

* * * * *